US005163393A

United States Patent [19]

Näslund

[11] Patent Number: 5,163,393

[45] Date of Patent: Nov. 17, 1992

[54] STARTING APPARATUS

[75] Inventor: Ulf W. Näslund, Huskvarna, Sweden

[73] Assignee: Aktiebolaget Electrolux, Stockholm, Sweden

[21] Appl. No.: 805,326

[22] Filed: Dec. 10, 1991

[30] Foreign Application Priority Data

Dec. 12, 1990 [SE] Sweden ..... 90039579

[51] Int. Cl.[5] ..... F02N 3/02

[52] U.S. Cl. ..... 123/185.3; 192/415; 74/7 C

[58] Field of Search ..... 123/185.3, 185.2, 185.4; 192/41 S, 42, 46; 74/7 C, 6

[56] References Cited

U.S. PATENT DOCUMENTS

| | | | |
|---|---|---|---|
| 3,754,543 | 8/1973 | Harkness . | |
| 4,149,510 | 4/1979 | Koga et al. | 123/185.3 |
| 4,422,417 | 12/1983 | Obermayer | 123/185.3 |
| 4,492,190 | 1/1985 | Greenwood et al. | 123/185.3 |
| 4,638,775 | 1/1987 | Lindstrom | 192/415 |
| 4,884,535 | 12/1989 | Iida et al. | 123/185.3 |
| 4,922,868 | 5/1990 | Ohkanda | 74/7 C |
| 4,970,998 | 11/1990 | Tyler | 74/7 C |

FOREIGN PATENT DOCUMENTS 279059 11/1951 Fed. Rep. of Germany .

*Primary Examiner*—E. Rollins Cross
*Assistant Examiner*—M. Macy
*Attorney, Agent, or Firm*—Pearne, Gordon, McCoy & Granger

[57] ABSTRACT

The invention relates to a starting apparatus for an i.c. engine comprising a driving clutch member (21) journalled and axially movable on a shaft, a bushing or the like (22), and cooperating with a second driven clutch member (23) on the flywheel of the engine. The axial movement of the driving clutch member, effected by pulling a starting rope (15), is provided by screw surfaces (25), when exposed to a relative rotary movement on the shaft, the bushing or the like. This movement is caused by a Bendix spring (27) braking the rotation of said first clutch member as it is wound in the rotary direction of the engine and fixed to the body of the starting apparatus. The spring is pretensioned to provide an axial, resilient force actuating the driving clutch member to return to its initial position when disengaged from the driven clutch member.

3 Claims, 2 Drawing Sheets

STARTING APPARATUS

The present invention relates to a starting apparatus provided on an i.c. engine at the flywheel of the engine and with a starting rope and a pull handle.

As regards prior art in this field it is known to arrange an adjustable driving clutch member on a shaft as well as a second clutch member coaxial with the first one on the engine shaft. As an example it can be mentioned that such a clutch connection is described in Swedish patent publication SE-PS-157 325. An apparatus with an adjustable clutch member of that kind usually includes a great number of different details with mutual plays and which are all exposed to wear and eventually have to be replaced. In order to get such an apparatus to function properly it must be provided with a friction brake that provides a relative movement between the clutch members during the very adjustment procedure of the driving member. Part of the available starting power will then be wasted, as the power consumed by the brake is not transferred to the engine. Therefore it is an important task to eliminate, as much as possible, the drawbacks existing in earlier apparatus by reducing wear, simplifying the design and decreasing the brake power.

According to the invention a starting apparatus is provided in which the axial movement of the driving clutch member, effected by pulling a starting rope, is generated by screw surfaces on the rope pulley and by a so-called Bendix spring wound around the clutch member. The spring has a braking action on the clutch member which is self-strengthening during the engagement, but decreasing during disengagement. The spring has an axial pretension in its attachment to the housing of the apparatus providing a force directed away from the flywheel and is then exerting a force on the driving clutch member which separates that part from the flywheel when the starting rope is released. Those and other features of the invented starting apparatus will be described in the following description and are summarized as characteristic features of the invention in the characterizing part of claim 1.

Figure 1:
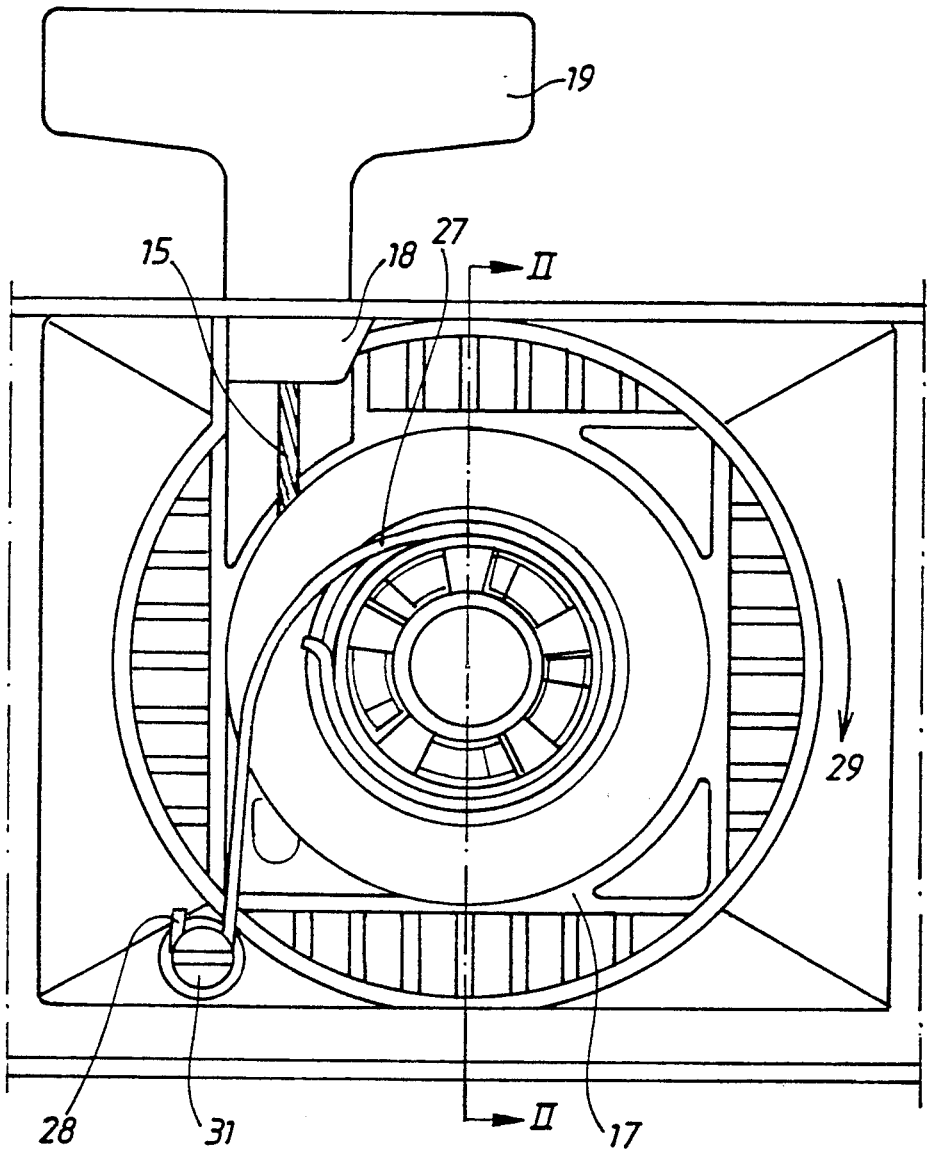
Figure 2:
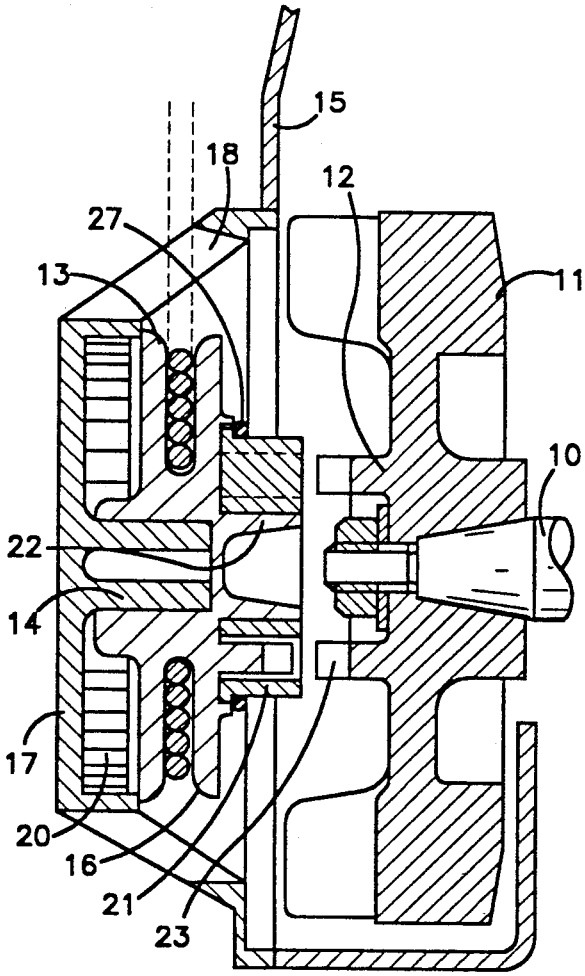
Figure 3:
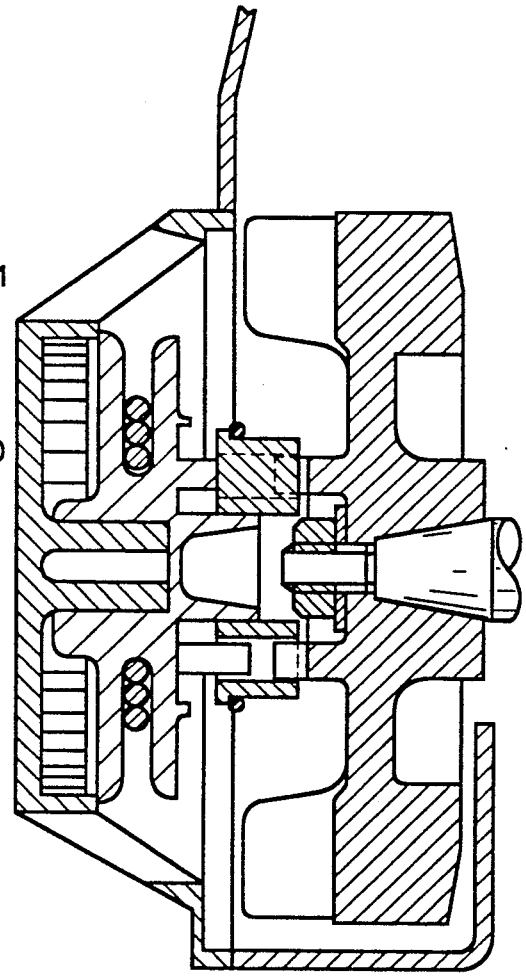
Figure 4:
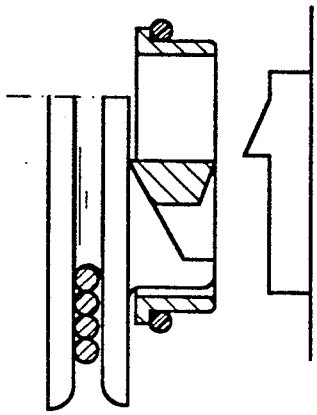
Figure 5:
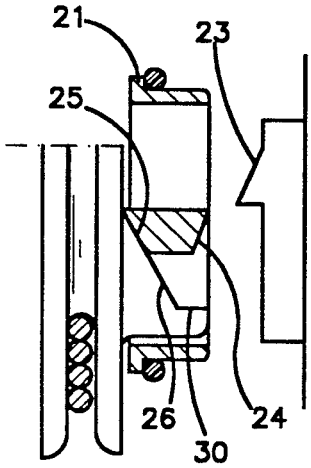

An example of an embodiment of a starting apparatus according to the invention is described in the following with reference to the drawings attached, in which FIG. 1 is a vertical projection of the starting apparatus, FIG. 2 is a section through the starting apparatus along the line II in FIG. 1, FIG. 3 is the same section as in FIG. 2 but with the parts in engaged position, FIG. 4 is a view of a rope pulley, a clutch member and a flywheel in engaged position, FIG. 5 is a view of the parts shown in FIG. 4 in a disengaged position.

The starting apparatus is intended to be used on a small engine, e.g. on a chain saw, a lawn mower, or an outboard engine. An engine shaft 10 supports a flywheel 11 that has fan blades and a clutch member 12 which is illustrated in detail in FIG. 2. A rope pulley 13 is journalled on a shaft 14 and is rotatable by pulling a starting rope 15 which is wound a plurality of turns in a rope groove 16 in the pulley. The shaft 14 is supported by a housing portion 17 having an opening 18 through which the rope extends to a handle 19. The rope pulley is also provided with a return spring 20 of the watch spring type, the outer end of which is attached to the housing 17 and the inner end to the rope pulley. This is the common design of a rope starter on which the arrangement according to the invention is based. The arrangement consists of few parts cooperating in the starting movement and returning to the initial position as follows.

An axially movable, driving clutch member 21 is journalled on a bushing 22 of the rope pulley which is rotatable on the shaft 14 coaxial with the crank-shaft 10 of the engine, on which shaft the flywheel is secured. The clutch member 12 on the flywheel is formed by axially extending teeth 23 having a straight front edge and a sloping back. The driving clutch member has corresponding teeth 24 meshing with the clutch of the flywheel when the driving clutch member is pushed towards the flywheel (FIG. 4). The opposite end of the clutch member has axial screw surfaces 25 engaging corresponding screw surfaces 26 on the rope pulley, when the driving clutch member is in its initial position (FIG. 5). Another necessary component is formed by a so-called Bendix spring 27 having an extended end 28 attached to the housing part 17. It is wound like a coil-spring around the cylindrically shaped clutch member in a winding direction that is opposite to that of the starting rope in the groove. The foremost property of the Bendix spring is that it tightens around the clutch member when that part rotates in the winding direction of the spring and, hence, the rotation of the clutch member is braked by the spring. Moreover, the end of the spring attached to the housing has a pretension that provides a resilient force actuating the clutch member in the direction towards the rope pulley.

The described apparatus has the following operating manner: When the starting rope is pulled out it is unwound from the rope pulley which is rotated in the direction shown by the arrow 29. The rotation of the clutch member (FIG. 5) is braked by the Bendix spring and its screw surfaces 25 slide on the corresponding surfaces 26 of the rope pulley whereby the clutch member is moved towards the flywheel. The teeth 23, 24 intermesh at the same time as the screw surfaces 25 and 26 turn into steps 30 on the rope pulley and the driving clutch member, respectively. All parts 13, 21, 11 are then in a firm operating connection and the tensile force of the rope is transferred to the crankshaft. During the rotation of the rope pulley the watch spring 20 is tensioned as a preparation for the return of the pulley to its initial position which occurs when the rope is released. The latter is then again wound onto the rope pulley that is now rotated by the watch spring in the other direction (opposite to arrow 29). The grip of the Bendix spring around the clutch member eases when the rotation of that member is reversed, and the pretension of the Bendix spring at its attachment 31 to the housing pulls the driving clutch member out of the mesh with the flywheel and towards the rope pulley (FIG. 2). The flywheel is then released from the starting apparatus and can rotate freely.

The apparatus now described is regarded an example of an embodiment of the invention. Variations might, of course, be possible within the scope of the invention. The rope pulley and the clutch member can, for example, be an integral part that is journalled and displaceable on the stationary shaft attached to the housing 17. Such variations are to be considered part of the inventive idea as defined in the following claims.

I claim:

1. Starting apparatus for an i.c. engine mounted at the flywheel (11) of the engine and comprising a free-wheel coupling having a driving clutch member (21) provided on a rope pulley (13) and a driven clutch member (23) provided on the flywheel, said driving clutch member being axially movable and provided with screw surfaces (25) in order to be displaced towards the flywheel to obtain a driving engagement therewith in response to a relative rotary movement between the rope pulley and the driving clutch member, a brake means for braking the rotation of said driving clutch member in order to obtain relative rotary movement, said brake means comprising a Bendix spring (27) one end of which is attached to the housing of the apparatus and the other end is wound around said driving clutch member in the direction of rotation of the engine to provide an increased braking power in said direction and a reduced braking power in the opposite direction in order to facilitate the return movement which is provided by a return spring (20), characterized in that the Bendix spring is attached to the housing in such way as to provide a resilient axial force actuating the driving clutch member to be moved in the direction towards the rope pulley when disengaged from the driven clutch member.

2. Starting apparatus according to claim 1, characterized in that the spring (27) is attached to the housing by pretension in order to provide said axial force.

3. Staring apparatus according to claim 1, characterized in that the rope pulley (13) is rotatably supported on a stationary shaft (14) attached to the housing and that the driving clutch member (21) is supported in a rotatable and axially movable manner on a shaft (22) provided on the rope pulley.

* * * * *